US005865307A

United States Patent [19]

Friedman

[11] Patent Number: 5,865,307

[45] Date of Patent: Feb. 2, 1999

[54] PERSONAL HOLDER FOR IRREGULAR SHAPE OBJECTS

[76] Inventor: Jack Friedman, 4476 Royal Fern Way, Palm Beach, Fla. 33410

[21] Appl. No.: 944,200

[22] Filed: Oct. 3, 1997

[51] Int. Cl.[6] ..... A45C 11/32

[52] U.S. Cl. ..... 206/37.1; 220/260; 220/324; 220/339

[58] Field of Search ..... 206/37, 38, 37.1, 206/38.1; 220/324, 326, 339, 260, 263, 281

[56] References Cited

U.S. PATENT DOCUMENTS

| | | | |
|---|---|---|---|
| 2,596,716 | 5/1952 | Otten | 206/37.1 |
| 2,631,631 | 3/1953 | Vogel | 206/38.1 |
| 2,849,044 | 8/1958 | Reitzel | 206/37.1 |
| 3,716,091 | 2/1973 | Gaines | 206/37 |
| 4,946,030 | 8/1990 | Guridi et al. | 206/37.1 |
| 5,076,460 | 12/1991 | Hussell | 220/324 |
| 5,511,390 | 4/1996 | Mah | 206/37.1 |

*Primary Examiner*—Jimmy G. Foster
*Attorney, Agent, or Firm*—Otto S. Kauder

[57] ABSTRACT

Disclosed is a one piece construction holder or container for irregularly shaped objects such as keys, dimensioned so as to fit within a card compartment of a conventional wallet, whereby said container is substantially rectangular and consists essentially of a rimmed top panel and a rimmed bottom panel integrally hinged together on one side, such that the hinge is thinner than either of the panels to which it is connected, and closure means on the opposite side from the hinge including a plug one one panel aligned with an accomodating hole on the other panel and mutually offset thumb access cutouts; the hinged top and bottom panels are disposed so as to hold the container open or snugly closed as required; the inside distance between the top panel and the bottom panel when the container is closed is defined by the width of the rim on each panel and is sufficient to accomodate from one to three keys placed in the container, and said distance taken together with the thickness of the top panel and the thickness of the bottom panel is no greater than the thickness of an object able to be accomodated within a wallet card compartment.

6 Claims, 2 Drawing Sheets

PERSONAL HOLDER FOR IRREGULAR SHAPE OBJECTS

This invention relates to a holder or container for irregular shape objects such as keys configured in such a way that the holder and its contents can be conveniently carried in a card compartment of an ordinary wallet.

BACKGROUND AND PRIOR ART

The inconvenience of carrying loose keys and other irregular shape objects in coat or trouser pockets has long been familiar to nearly everyone. Edges and corners can be sharp enough to wear through cloth, resulting in the loss of the object, and can also cause scratches and cuts on a person's hands. Traditionally, there have been provided a variety of cases and carriers, usually made of leather or plastic with the appearance and feel of leather, with snap or slide fastener closures and interior wire holders or clips to which keys can be attached; such carriers usually provide a degree of visual elegance beyond mere utility, and are priced accordingly.

It has also been proposed to enable a key to be securely carried in a compartment of a wallet. With a loose key this is only marginally better than in a trouser pocket. A variety of holders have been designed, inevitably constrained by the limited space available in a wallet compartment. One automobile manufacturer, who provides a single key having a metal shank portion with two prongs fitted into an elliptical plastic grip to unlock the doors, the trunk, and the ignition, also gives customers a spare key in a thin plastic pouch to fit in a wallet compartment. However, this spare key consists only of the metal shank portion without the plastic grip and hence requires considerable exertion by the user to turn in the lock.

R Mandelbaum U.S. Pat. No. 1,599,480 disclosed a combination flashlight and compartment in which keys are to be stored as an elongated hollow body having semicircular ends, closed at the top by a roof with a threaded sleeve for inserting a flashlight bulb and at the bottom by a door hinged so as to swing downward. A dished out rectangular portion of one side wall serves to hold one or more keys and is accessed from the outside by a door that slides vertically to a closed or open position.

V Powell U.S. Pat. No. 2,571,609 disclosed a container for receiving and retaining a motor vehicle operator's license in assembly with a motor vehicle ignition key, in which the key is attached to the license by a ring passing through the license.

H Thomas U.S. Pat. No. 2,713,368 disclosed a holder for defect cards for railway equipment as a thin elongated container open at one end and closed by a replaceable hinged cover which fits down over the upper edges of the body and is provided with sealling means which prevents moisture from entering, attached to the side of the car body in which defect cards may be inserted and removed as required. The holder is made up two pieces, a body and a cover therefor. The preferred manner of connecting the body and cover is by rabbeting a groove in the top rear edge of the back of the body, with the back of the cover fitting in and filling the rabbet.

J Marks U.S. Pat. No. 4,037,716 disclosed a pocket sized or credit card sized card holder comprised of a thin card having a depressed region therein for receiving and containing the items and a pressure relealable at least partially adhesively coated lid whlichcovers the depressed region and which can be stripped or peeled back to expose the items.

J Watson U.S. Pat. No. 4,286,641 disclosed an enclosure for storing one or more keys in singular compartments, being sized and shaped as a conventional credit card, planar and rectangular, and including a clear plastic face with one or more slits and further including a diagonal heat seal whilch seals two flexible sheets together to form two separate compartments.

D China U.S. Pat. No. 4,300,610 disclosed a card-like holder for keys, coins and the like which is generally rectangular in cross-section, including a tray member and an insert member receivable within the tray member. The tray member includes a rigid frame portion having opposed faces and an aperture for receiving the insert member, and a flexible film disposed over one of the faces of the frame to form a backing. The insert member conforms in configuration to the frame aperture so as to be receivable therein. The insert includes a rigid holder portion having a pair of opposed faces and an aperture for receiving the item to be contained in the holder. The insert also includes a flexible film disposed over one of the faces of the insert holder portion to form a backing for the insert aperture.

R Lederer U.S. Pat. No. 4,331,194 disclosed a portable credit card size holder for keys comprising a laminated assembly having two plies of thermoplastic film sealed together at their marginal edges, a flat card-like insert sandwiched between the plies of film, and the ply of film continuous to the end portions having a pair of slits forming two end pockets accomodating insertion of keys.

T Morita U.S. Pat. No. 4,593,736 disclosed a case having a protective function for a card with magnetically recorded data, which may have a flap closing the top and which includes a strongly magnetic mesh held between the lining and the surface of the case.

E Cartwright U.S. Pat. No. 4,939,917 disclosed a tamperproof key holder comprised of a first plate having a routed region located therein and a second plate superimposed over said first plate, a single pin holding the first and second plate together in a pivotal relationship and a key ring holding the key to the first plate.

J Guridi et al U.S. Pat. No. 4,946,030 disclosed retaining keys separably within corresponding apertures of the card or hingedly attached such that the keys may pivot into and out of the plane of the card.

R Wentz U.S. Pat. No. 5,125,531 disclosed a carrying case for personal articles to be worn around the neck with a lower part and an upper part or cover hinged to the lower part, the upper and lower parts forming a water tight enclosure when a hasp releasably connects the outer end of the upper part to the lower part.

M. Mah U.S. Pat. No. 5,511,390 disclosed a locket holder for keys comprising a casing being a pair of complementary half-sections with each half section having a recessed chamber and a component formed within each recessed chamber in each half-section for retaining the keys. A structure suspends the casing from about the neck of a person.

The complexity of these devices and the consequent requirement for a multiplicity of steps in the manufacture thereof is evident. To the extent that the disclosed receptacles are closely fitted to the keys or other objects to be retained, their usefulness is limited to the particular fitting object and does not extend to others.

There remains a need for a wallet fitting holder of simplified design and versatility in its ability to hold objects of a variety of shapes.

SUMMARY OF THE INVENTION

In accordance with this invention, there is provided a one piece construction holder or container for irregularly shaped objects such as keys, dimensioned so as to fit within a card compartment of a conventional wallet. The container is substantially rectangular and consists essentially of a rimmed top panel and a rimmed bottom panel integrally hinged together on one side, such that the hinge is thinner than either of the panels to which it is connected, and closure means on the opposite side from the hinge including a plug one one panel aligned with an accomodating hole on the other panel and mutually offset thumb access cutouts. The hinged top and bottom panels are disposed so as to hold the container open or snugly closed as required; the inside distance between the top panel and the bottom panel when the container is closed is defined by the width of the rim on each panel and is sufficient to accomodate from one to three keys placed in the container, and said distance taken together with the thickness of the top panel and the thickness of the bottom panel is no greater than the thickness of an object able to be accomodated within a wallet card compartment.

Such a container accomodates keys and other objects of similar size and whatever shape, holds them securely when closed, permits their easy insertion and removal when opened, and only minimally adds to the bulk of the objects themselves.

The phrase "consisting essentially of" is used in the specification and claims in its art recognized meaning to permit the addition of only such unstated features as are consistent with the objectives of the invention, thus excluding outside attachments or interior recesses, pockets and the like that objectionably increase the bulk, thickness or complexity of the container.

These drawings are only illustrative and not intended to limit the invention. For example, within the constraints of fitting inside a wallet card compartment, each of the dimensions can be within a certain range greater and smaller than drawn. The top and bottom panels can have right angled or rounded corners. The lock alignment hole and plug can have any convenient matching shape as well as round. The hinge and closure can each be located along the shorter edge of the container as well as the longer edge as drawn. The relative positions of the thumb access cutouts in the top and bottom panels to the right of the lock hole and to the left of the lock plug can be reversed, with the thumb access cutout in the top panel to the left of the lock hole and the thumb access cutout in the bottom panels to the right of the lock plug.

DESCRIPTION OF THE PREFERRED EMBODIMENTS

Figure 1:
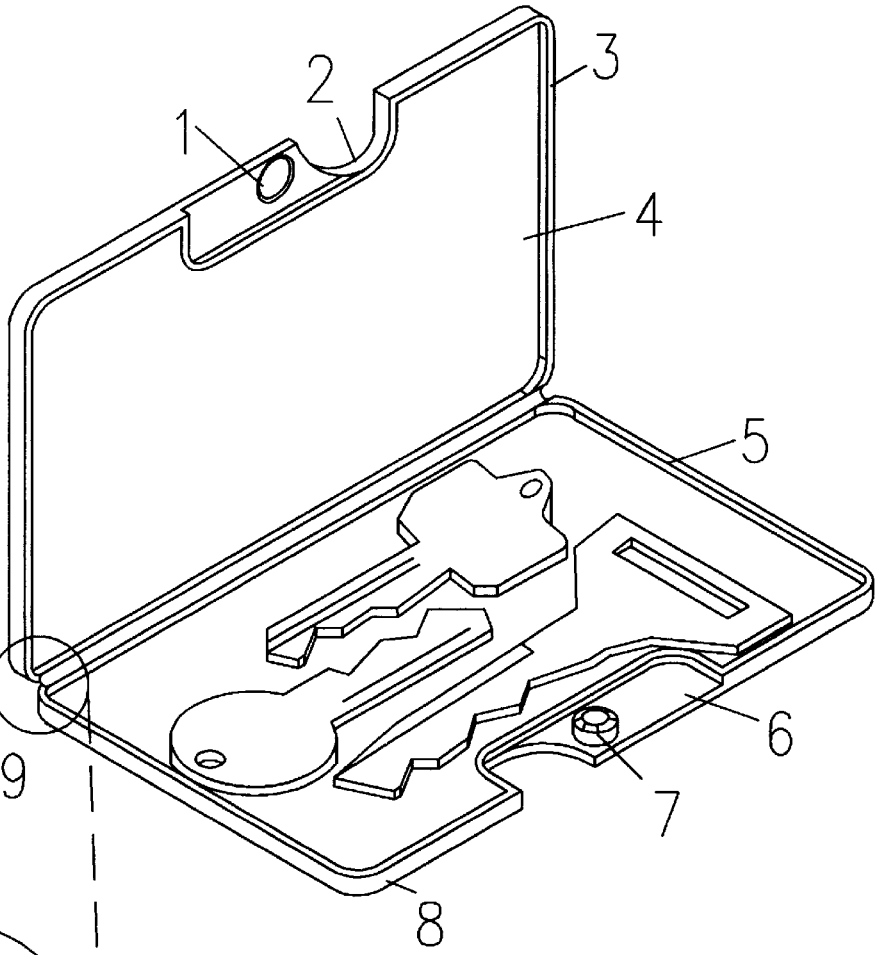
FIG. 1 is a perspective view of a partly open container resting on its bottom panel, which is integrally hinged to the top panel such that the largest dimension is hinged, also showing closure means includinging a round lock alignment plug on the bottom panel, a round accomodating lock alignment hole in the top panel and mutually offset thumb access cutouts in the top and bottom panels, with the cutout of the top panel to the right of the hole and the cutout of the bottom panel an equal distance to the left of the plug.

In a preferred embodiment, a container according to this invention as illustrated in FIG. 1 can be formed of a single sheet of resilient material into a top panel 4 and bottom panel 5 having substantially equal dimensions and linked through integral hinge 9 extending along the longest dimension of the panels. Opposite the hinge, each of the top and bottom panels has an opening surface 6 with lock alignment hole 1 substantially centered in the top panel opening surface and lock alignment plug 7 substantially centered in the bottom panel opening surface, and thumb access cutouts 2 to the right of the lock alignment hole in the top panel opening surface and to the left of the lock alignment plug in the bottom panel opening surface. When the container is closed, the upper rim 3 and lower rim 8 come together and the lock alignment plug 7 fits into the lock alignment hole 1 so as to snugly retain the keys or other objects placed within with no additional device needed to keep them in place.

The dimensions of a container according to this invention are such that the closed container fits into a card compartment of a conventional wallet. Accordingly, the length and width of such container are substantially those of a standard credit card, ranging from 3 to 3.5 inches in length, preferably from 3.3 to 3.4 inches, and from 1.8 to 2.1 inches in width, preferably from 1.9 to 2.05 inches. The thickness of such container when closed ranges from 0.16 to 0.2 inches, preferably from 0.17 to 0.19 inches. Within said overall thickness, the thickness of the top and bottom panels 4 and 5 can range from 0.03 to 0.045 inches, preferably from 0.035 to 0.042 inches, and the overall height of the rims 3 and 8 can range from 0.08 to 0.1 inches, preferably from 0.085 to 0.095 inches.

Figure 2A:
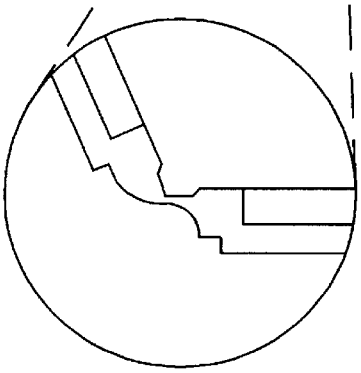
FIG. 2A is an enlarged end view of the hinge area of a container such as that of FIG. 1 in the same partly open position.
Figure 2B:
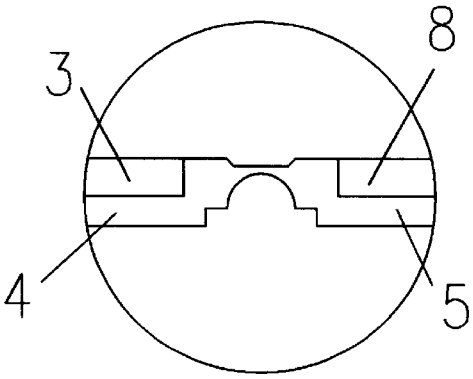
FIG. 2B is an enlarged end view of the same hinge area in a fully open position.
Figure 2C:
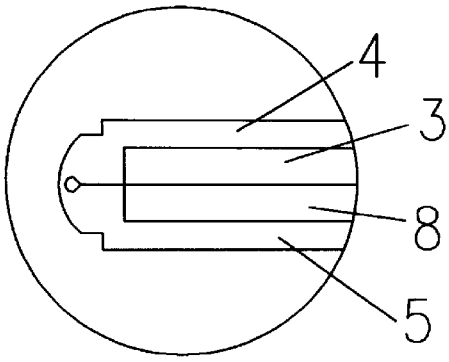
FIG. 2C is an enlarged end view of the same hinge area in a closed position.

A preferred execution of the integral hinge in the container of this invention is illustrated in FIG. 2A, 2B, and 2C. Shown to the left of the thinnest part at the center of the hinge in FIG. 2A and 2B is progressively narrowing top panel 4, with upper rim 3 further to the left, and shown to the right of the thinnest part at the center of the hinge in FIG. 2A and 2B is progressively narrowing bottom panel 5, with lower rim 8 further to the right. The ratio of the thickness of the top panel to the thickness of the hinge at its thinnest part ranges from 7.5: 1 to 2.5:1, preferably 5.5:1 to 3:1. When the container is closed, the hinge takes the form shown in FIG. 2C with upper rim 3 and lower rim 8 coming together and defining the space between top panel 4 and bottom panel 5 in which the desired objects are securely contained.

At its thinnest point, which is preferably midway between top panel 4 and bottom panel 5, the hinge thickness can range from 0.006 to 0.012 inch, preferably 0.008 to 0.11 inch. The hinge land length can range from 0.06 to 0.12 inch, preferably 0.09 to 0.11 inch, defined by a tapered portion between 0.009 to 0.011 inch high at an angle between 40 and 50 degrees. The hinge radius can range from 0.04 to 0.053 inch, preferably from 0.045 to 0.049 inch.

Figure 3:
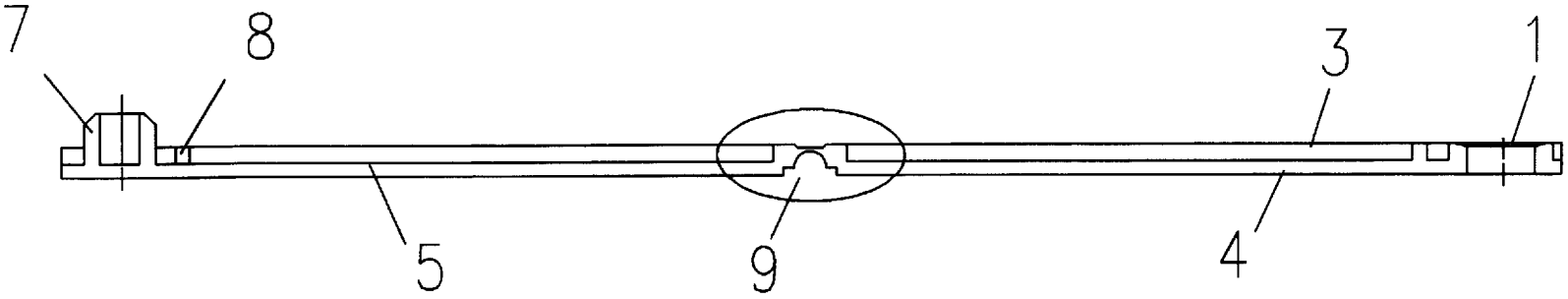
FIG. 3 is a cross-sectional view of a container such as that of FIG. 1 in the open position along a line connecting the locking hole in the top panel and the locking plug of the bottom panel.

A preferred execution of the alignment lock hole land alignment lock plug 7 in the container of this invention is illustrated in the cross-sectional view of FIG. 3. The plug 7 rises out of the opening surface 6 at the far left to a height close to but not exceeding the thickness of the container when closed, preferably 0.16 to 0.18 inch. The plug can be hollow with a wall thickness of 0.06 to 0.09 inch, as well as solid. To facilitate fitting into the hole the top of the plug and the upper edge of the hole can each be tapered at an angle between 40 and 50 degrees. The outside diameter of the plug and the inside diameter of the hole are substantially identical and can range from 0.17 to 0.21 inch, preferably from 0.18 to 0.2 inch.

The container according to this invention can be manufactured by a variety of well known methods such as injection molding, vacuum forming, cold drawing, profile extrusion, or folding and heat sealing an appropriately shaped flat blank.

The container is preferably made of resilient plastic. Resilient plastic is defined as any plastic able to return to original dimensions after deformation and having a stiffness modulus intermediate between that of a rigid plastic and that of a flexible plastic, typically greater than 60000 pounds per square inch and less than 100000 pounds per square inch. Such plastics include, for example, low density polyethylene, linear low density polyethylene, ethylene—vinyl acetate copolymer, propylene homopolymer and copolymers of propylene with ethylene and/or other alpha-olefins in which propylene is the monomer present in greatest concentration, rubber-modified polystyrene, vinyl chloride homopolymer plasticized with 17–30 parts of di-2-ethylhexyl phthalate plasticizer or equivalent efficiency levels of other plasticizers, and copolymers of vinyl chloride with 10–15% of vinyl acetate. Propylene polymers are particularly preferred.

What is claimed is:

1. A one piece construction holder or container for irregularly shaped objects such as keys, dimensioned so as to fit within a card compartment of a conventional wallet, whereby said container is substantially rectangular and consists essentially of a rimmed top panel and a rimmed bottom panel integrally hinged together on one side, such that the hinge is thinner than either of the panels to which it is connected, and closure means on the opposite side from the hinge including a plug on one panel aligned with an accomodating hole on the other panel and mutually offset thumb access cutouts; the hinged top and bottom panels are disposed so as to hold the container snugly closed when said plug is inserted in said hole; the inside distance between the top panel and the bottom panel when the container is closed is defined by the width of the rim on each panel and is sufficient to accomodate from one to three keys placed in the container, and said distance taken together with the thickness of the top panel and the thickness of the bottom panel is no greater than the thickness of an object able to be accomodated within a wallet card compartment.

2. A container according to claim 1 in which the length of each panel ranges from 3 to 3.5 inches, the width of each panel ranges from 1.8 to 2.1 inches, and the overall thickness ranges from 0.16 to 0.2 inch.

3. A container according to claim 1 in which the ratio of the thickness of the top panel to the thickness of the hinge at its thinnest part ranges from 7.5:1 to 2.5:1.

4. A container according to claim 1 in which the lock alignment plug is round, hollow, and 0.17 to 0.21 inch in outside diameter.

5. A container according to claim 1 essentially constructed of resilient plastic.

6. A container according to claim 5 essentially constructed of propylene polymer.

* * * * *